US009687050B2

(12) United States Patent
Lin

(10) Patent No.: US 9,687,050 B2
(45) Date of Patent: Jun. 27, 2017

(54) ZIPPER HEAD ASSEMBLY STRUCTURE FOR DECREASING FRICTIONAL RESISTANCE AND SLIDING MEMBER THEREOF

(71) Applicant: CHUNG CHWAN ENTERPRISE CO., LTD., Tao Yuan Hsien (TW)

(72) Inventor: Yu-Pau Lin, Taoyuan County (TW)

(73) Assignee: CHUNG CHWAN ENTERPRISE CO., LTD., Taoyuan Hsien (TW)

( * ) Notice: Subject to any disclaimer, the term of this patent is extended or adjusted under 35 U.S.C. 154(b) by 317 days.

(21) Appl. No.: 14/557,383

(22) Filed: Dec. 1, 2014

(65) Prior Publication Data

US 2016/0095393 A1 Apr. 7, 2016

(30) Foreign Application Priority Data

Oct. 3, 2014 (TW) ..... 103134551 A

(51) Int. Cl.
*A44B 19/26* (2006.01)

(52) U.S. Cl.
CPC ..... *A44B 19/26* (2013.01)

(58) Field of Classification Search
CPC ..... A44B 19/26
See application file for complete search history.

(56) References Cited

U.S. PATENT DOCUMENTS 2,870,507 A * 1/1959 Poux ..... A44B 19/26 24/415

FOREIGN PATENT DOCUMENTS

| | | |
|---|---|---|
| JP | 1234041 | 8/1977 |
| KR | 200276045 Y1 | 5/2002 |
| KR | 10-0421396 | 3/2004 |
| KR | 100863370 B1 | 10/2008 |

* cited by examiner

*Primary Examiner* — Jack W Lavinder
(74) *Attorney, Agent, or Firm* — Li & Cai Intellectual Property (USA) Office

(57) ABSTRACT

A zipper head assembly structure for decreasing frictional resistance includes a sliding member and a pulling member. The sliding member has a first sliding portion, a second sliding portion, and a connection portion connected between the first and the second sliding portions. The pulling member has an end portion movably mated with a retaining body of the first sliding portion. The first sliding portion has a first inner surface and a first outer surface opposite to the first inner surface, the first sliding portion has a plurality of first sliding blocks disposed on the first inner surface thereof and separated from each other. The second sliding portion has a second inner surface and a second outer surface opposite to the second inner surface, and the second sliding portion has a plurality of second sliding blocks disposed on the second inner surface thereof and separated from each other.

8 Claims, 5 Drawing Sheets

ZIPPER HEAD ASSEMBLY STRUCTURE FOR DECREASING FRICTIONAL RESISTANCE AND SLIDING MEMBER THEREOF

BACKGROUND OF THE INVENTION

1. Field of the Invention

The instant disclosure relates to a zipper head assembly structure and a sliding member thereof, and more particularly to a zipper head assembly structure for decreasing frictional resistance and a sliding member thereof.

2. Description of Related Art

In general, zippers are basic elements in clothing or accessories. Compare to buttons, the zippers are easier to use. A conventional zipper comprises a zipper head and a tape. The zipper head works with the tape to allow the pulling action. Recently, the zipper has being used commonly for clothing, pants, backpack, and other accessories.

SUMMARY OF THE INVENTION

One aspect of the instant disclosure relates to a zipper head assembly structure and a sliding member thereof for decreasing frictional resistance between the sliding member and a zipper teeth structure.

One of the embodiments of the instant disclosure provides a zipper head assembly structure for decreasing frictional resistance, comprising: a sliding member and a pulling member. The sliding member has a first sliding portion, a second sliding portion corresponding to the first sliding portion, and a connection portion connected between the first sliding portion and the second sliding portion, and the first sliding portion has a retaining body. The pulling member has an end portion movably mated with the retaining body. In addition, the first sliding portion has a first inner surface and a first outer surface opposite to the first inner surface, the first sliding portion has a plurality of first sliding blocks disposed on the first inner surface thereof and separated from each other, and the retaining body is disposed on the first outer surface of the first sliding portion. The second sliding portion has a second inner surface and a second outer surface opposite to the second inner surface, and the second sliding portion has a plurality of second sliding blocks disposed on the second inner surface thereof and separated from each other.

Another one of the embodiments of the instant disclosure provides a sliding member for decreasing frictional resistance, comprising: a first sliding portion, a second sliding portion corresponding to the first sliding portion, and a connection portion connected between the first sliding portion and the second sliding portion. In addition, the first sliding portion has a first inner surface and a first outer surface opposite to the first inner surface, the first sliding portion has a plurality of first sliding blocks disposed on the first inner surface thereof and separated from each other, and the first sliding portion has a retaining body disposed on the first outer surface of the first sliding portion. The second sliding portion has a second inner surface and a second outer surface opposite to the second inner surface, and the second sliding portion has a plurality of second sliding blocks disposed on the second inner surface thereof and separated from each other.

Yet another one of the embodiments of the instant disclosure provides a zipper head assembly structure for decreasing frictional resistance, the zipper head assembly structure is disposed on a zipper teeth structure including a first zipper teeth member and a second zipper teeth member mated with each other, and the zipper head assembly structure comprises a sliding member and a pulling member. The sliding member has a first sliding portion, a second sliding portion corresponding to the first sliding portion, and a connection portion connected between the first sliding portion and the second sliding portion, and the first sliding portion has a retaining body. The pulling member has an end portion movably mated with the retaining body. In addition, the first sliding portion has a first inner surface and a first outer surface opposite to the first inner surface, the first sliding portion has a plurality of first sliding blocks disposed on the first inner surface thereof and separated from each other, and the retaining body is disposed on the first outer surface of the first sliding portion. The second sliding portion has a second inner surface and a second outer surface opposite to the second inner surface, and the second sliding portion has a plurality of second sliding blocks disposed on the second inner surface thereof and separated from each other. The first zipper teeth member includes a first zipper teeth carrier for contacting the first sliding blocks and a plurality of first zipper teeth disposed on the first zipper teeth carrier for contacting the second sliding blocks, and the second zipper teeth member includes a second zipper teeth carrier for contacting the first sliding blocks and a plurality of second zipper teeth disposed on the second zipper teeth carrier for contacting the second sliding blocks.

More precisely, the first sliding portion has a first partition block disposed on the first inner surface thereof and between two of the first sliding blocks, and the second sliding portion has a second partition block disposed on the second inner surface thereof and between two of the second sliding blocks, wherein the first partition block and the second partition block are disposed face to face with each other, the height of the first partition block is larger than the height of each first sliding block, and the height of the second partition block is larger than the height of each second sliding block, wherein the second sliding portion has two lateral walls respectively extended from two opposite lateral sides thereof and along a direction facing the first inner surface of the first sliding portion, and the sliding member has a first gap formed between one of the two lateral walls and the first inner surface of the first sliding portion and a second gap formed between the other lateral wall and the first inner surface of the first sliding portion.

More precisely, the sliding member has a receiving space formed among the first sliding portion, the second sliding portion and the two lateral walls, and the receiving space is divided into a first sliding space and a second sliding space communicated with the first sliding space by matching the first partition block, the second partition block and the connection portion, wherein some of the first sliding blocks and some of the second sliding blocks are disposed inside the first sliding space, and the other first sliding blocks and the other second sliding blocks are disposed inside the second sliding space.

More precisely, both the first zipper teeth carrier and the second zipper teeth carrier are slidably disposed on the first sliding blocks, and both the first zipper teeth carrier and the second zipper teeth carrier are separated from the first inner surface of the first sliding portion by a first predetermined distance, wherein both the first zipper teeth and the second zipper teeth are slidably disposed on the second sliding blocks, and both the first zipper teeth and the second zipper teeth are separated from the second inner surface of the second sliding portion by a second predetermined distance.

Therefore, when both the first zipper teeth carrier and the second zipper teeth carrier are slidably disposed on the first sliding blocks, both the first zipper teeth carrier and the second zipper teeth carrier are separated from the first inner surface of the first sliding portion by a first predetermined distance, so that both the first zipper teeth carrier and the second zipper teeth carrier cannot directly contact the first inner surface of the first sliding portion in order to decrease the frictional resistance between the first zipper teeth carrier (or the second zipper teeth carrier) and the first sliding portion. In addition, when both the first zipper teeth and the second zipper teeth are slidably disposed on the second sliding blocks, both the first zipper teeth and the second zipper teeth are separated from the second inner surface of the second sliding portion by a second predetermined distance, so that both the first zipper teeth and the second zipper teeth cannot directly contact the second inner surface of the second sliding portion in order to decrease the frictional resistance between the first zipper teeth (or the second zipper teeth) and the second sliding portion. Therefore, the slideness or the smoothness of the zipper head assembly structure sliding on the zipper teeth structure is increased.

To further understand the techniques, means and effects of the instant disclosure applied for achieving the prescribed objectives, the following detailed descriptions and appended drawings are hereby referred to, such that, and through which, the purposes, features and aspects of the instant disclosure can be thoroughly and concretely appreciated. However, the appended drawings are provided solely for reference and illustration, without any intention to limit the instant disclosure.

DETAILED DESCRIPTION OF THE PREFERRED EMBODIMENTS

The embodiments of "a zipper head assembly structure for decreasing frictional resistance and a sliding member thereof" of the instant disclosure are described. Other advantages and objectives of the instant disclosure can be easily understood by one skilled in the art from the disclosure. The instant disclosure can be applied in different embodiments. Various modifications and variations can be made to various details in the description for different applications without departing from the scope of the instant disclosure. The drawings of the instant disclosure are provided only for simple illustrations, but are not drawn to scale and do not reflect the actual relative dimensions. The following embodiments are provided to describe in detail the concept of the instant disclosure, and are not intended to limit the scope thereof in any way.

Referring to FIG. 1 to FIG. 6, the instant disclosure provides a sliding member 1 (or a sliding head) for decreasing frictional resistance, and the sliding member 1 has a first sliding portion 11, a second sliding portion 12 corresponding to the first sliding portion 11, and a connection portion 13 connected between an end portion of the first sliding portion 11 and an end portion of the second sliding portion 12.

Figure 1:
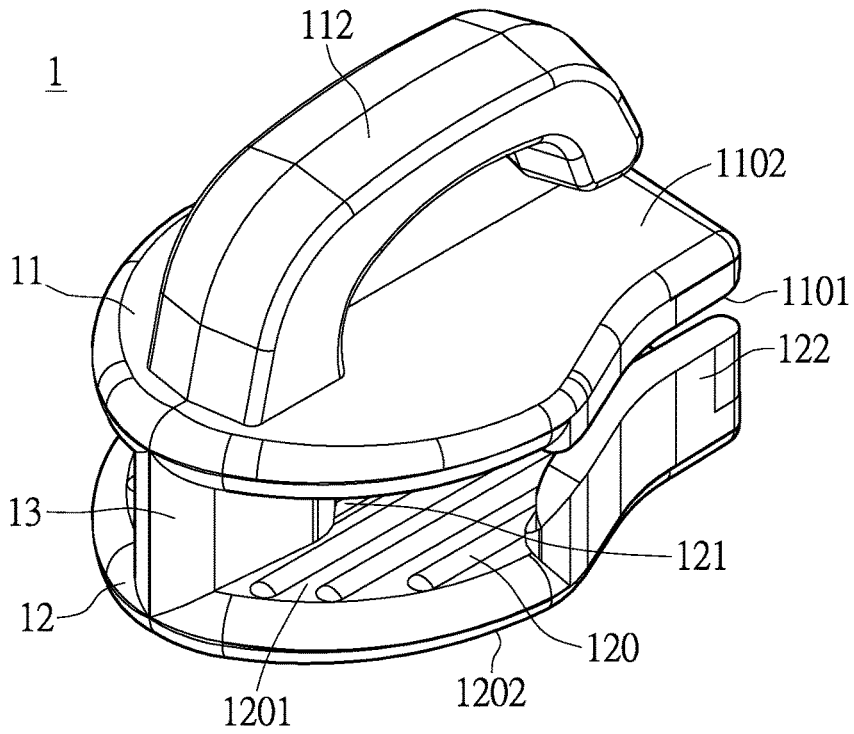
FIG. 1 shows a perspective, schematic view of a sliding member for decreasing frictional resistance according to the instant disclosure.
Figure 2:
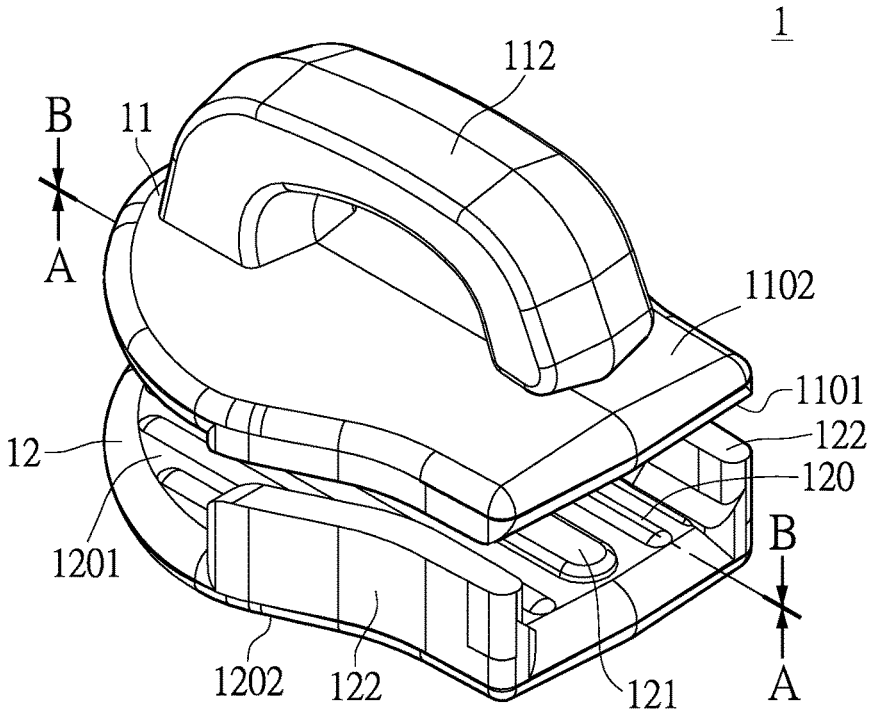
FIG. 2 shows another perspective, schematic view of a sliding member for decreasing frictional resistance according to the instant disclosure.
Figure 3:
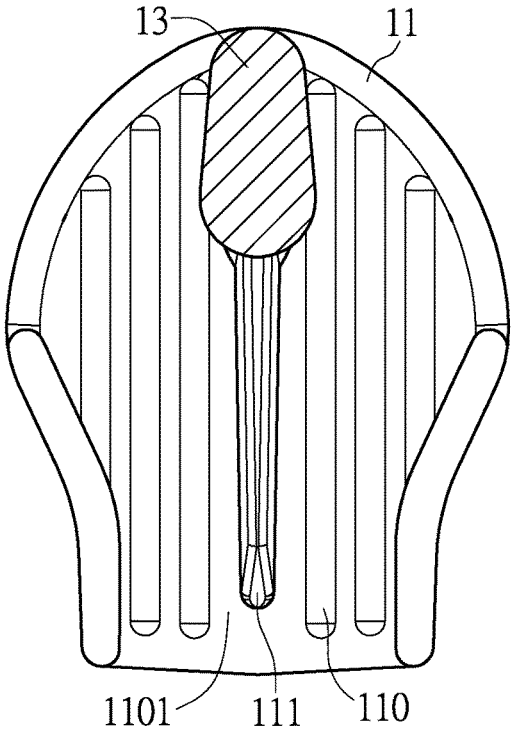
FIG. 3 shows a cross-sectional view taken along the section line A-A of FIG. 2.

First, referring to FIG. 1, FIG. 2 and FIG. 3, the first sliding portion 11 has a first inner surface 1101 and a first outer surface 1102 opposite to the first inner surface 1101. The first sliding portion 11 has a plurality of first sliding blocks 110 disposed on the first inner surface 1101 thereof and separated from each other by a predetermined distance, and the first sliding portion 11 has a retaining body 112 (such as a hook body) disposed on the first outer surface 1102 thereof. For example, referring to FIG. 3, the first sliding block 110 may be shown as a stripe (or linear) shape or any shape, and the first sliding blocks 110 are parallel with each other on the first inner surface 1101 of the first sliding portion 11.

Figure 4:
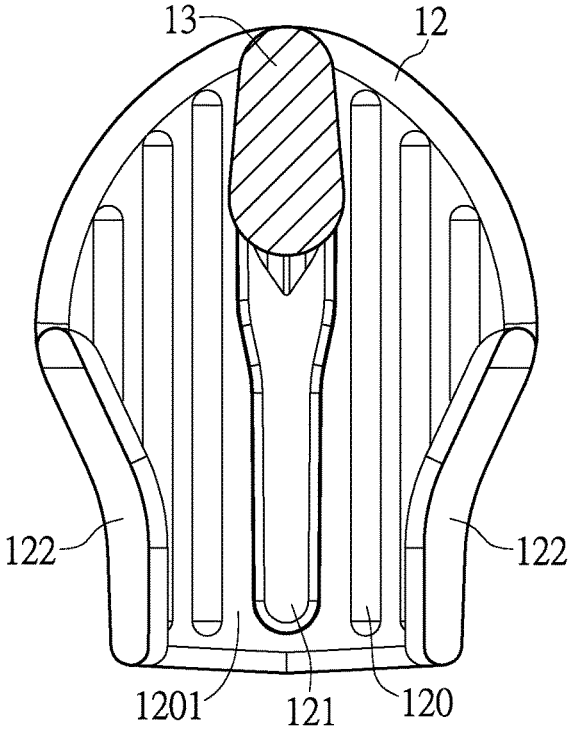
FIG. 4 shows a cross-sectional view taken along the section line B-B of FIG. 2.

Moreover, referring to FIG. 1, FIG. 2 and FIG. 4, the second sliding portion 12 has a second inner surface 1201 and a second outer surface 1202 opposite to the second inner surface 1201, and the second sliding portion 12 has a plurality of second sliding blocks 120 disposed on the second inner surface 1201 thereof and separated from each other by a predetermined distance. For example, referring to FIG. 4, the second sliding block 120 may be shown as a stripe (or linear) shape or any shape, and the second sliding blocks 120 are parallel with each other on the second inner surface 1201 of the second sliding portion 12.

It is worth mentioning that the first sliding block 110 and the second sliding block 120 can be disposed face to face with each other or arranged alternately, but that is merely an example and is not meant to limit the instant disclosure.

Figure 5:
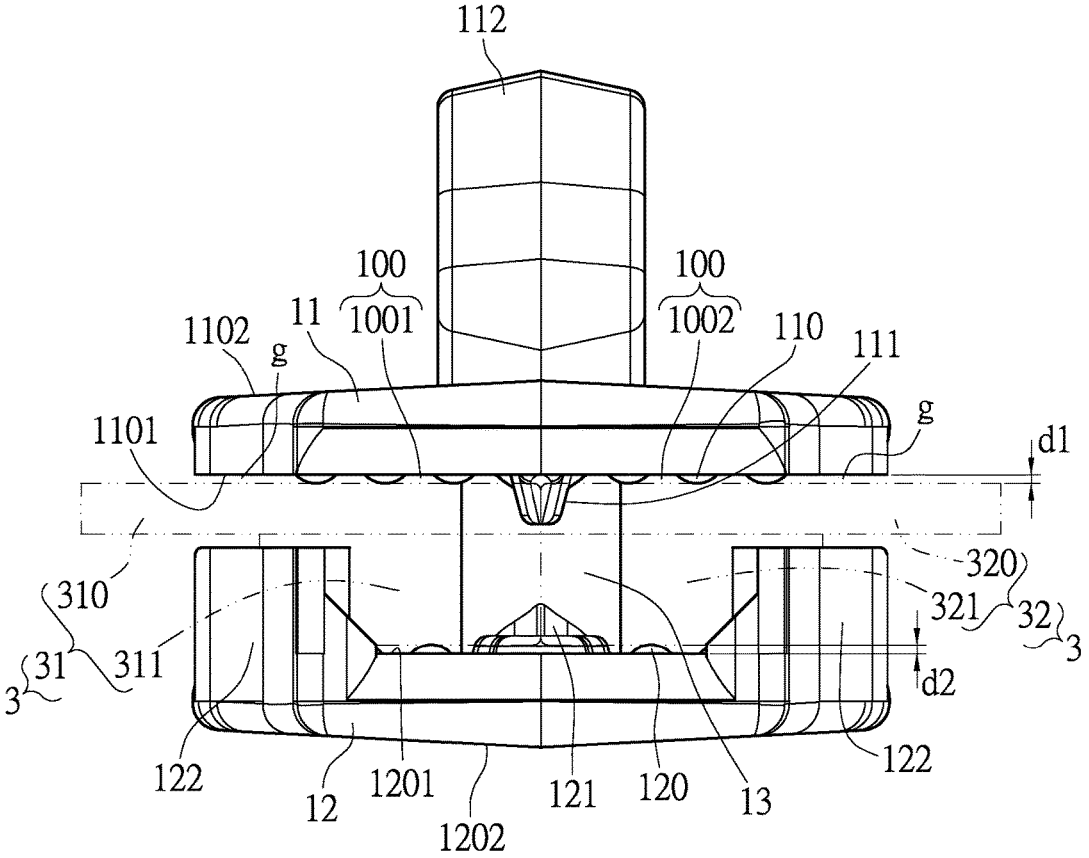
FIG. 5 shows a front, schematic view of a sliding member for decreasing frictional resistance slidably disposed on a zipper teeth structure according to the instant disclosure.

More precisely, referring to FIG. 2, FIG. 3, FIG. 5 and FIG. 6, the first sliding portion 11 has a first partition block 111 disposed on the first inner surface 1101 thereof and between two of the first sliding blocks 110 (such as two adjacent first sliding blocks 110), and the second sliding portion 12 has a second partition block 121 disposed on the second inner surface 1201 thereof and between two of the second sliding blocks 120 (such as two adjacent second sliding blocks 120). As shown in FIG. 5, the first partition block 111 and the second partition block 121 are disposed face to face with each other (i.e., the first partition block 111 and the second partition block 121 are facing each other). The height of the first partition block 111 relative to the first inner surface 1101 is larger than the height of each first sliding block 110 relative to the first inner surface 1101, and the height of the second partition block 121 relative to the second inner surface 1201 is larger than the height of each second sliding block 120 relative to the second inner surface 1201. In addition, referring to FIG. 4 and FIG. 5, the second sliding portion 12 has two lateral walls 122 respectively extended from two opposite lateral sides thereof and along a direction facing the first inner surface 1101 of the first sliding portion 11, and the sliding member 1 has a first gap g formed between one of the two lateral walls 122 and the first inner surface 1101 of the first sliding portion 11 and a second gap g formed between the other lateral wall 122 and the first inner surface 1101 of the first sliding portion 11.

Figure 6:
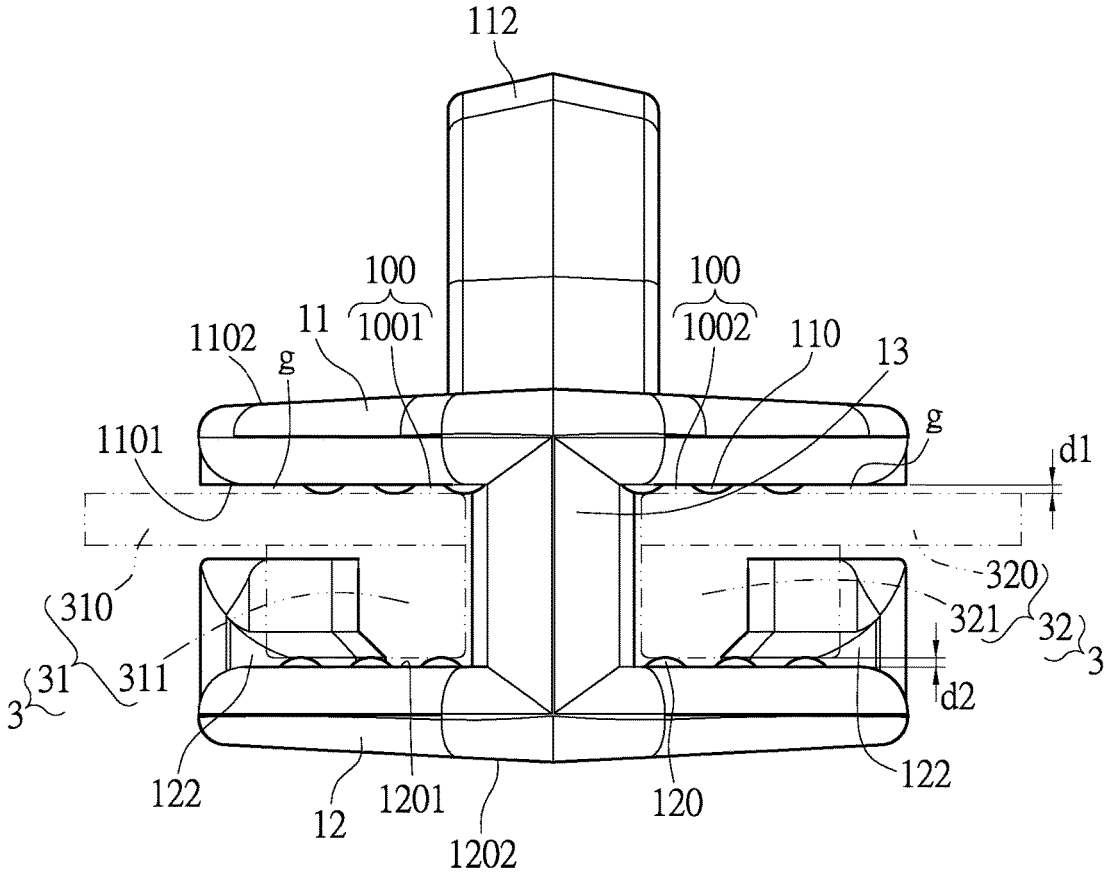
FIG. 6 shows a rear, schematic view of a sliding member for decreasing frictional resistance slidably disposed on a zipper teeth structure according to the instant disclosure.

More precisely, referring to FIG. 5 and FIG. 6, the sliding member 1 has a receiving space 100 formed among the first sliding portion 11, the second sliding portion 12 and the two lateral walls 122, and the receiving space 100 is divided into a first sliding space 1001 and a second sliding space 1002 communicated with the first sliding space 1001 by matching the first partition block 111, the second partition block 121 and the connection portion 13. Some of the first sliding blocks 110 and some of the second sliding blocks 120 are disposed inside the first sliding space 1001, and the other first sliding blocks 110 and the other second sliding blocks 120 are disposed inside the second sliding space 1002.

Figure 7:
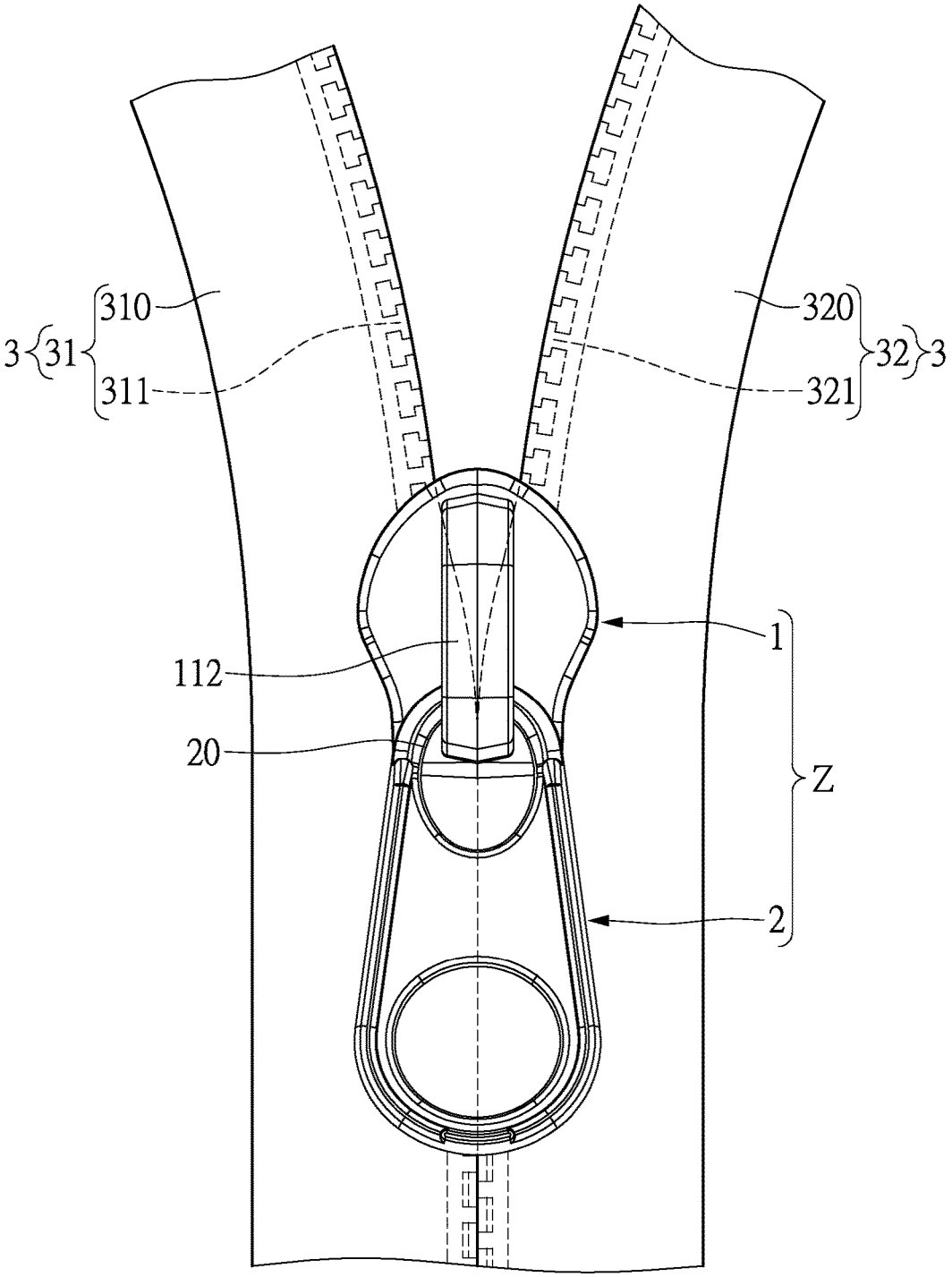
FIG. 7 shows a top, schematic view of a zipper head assembly structure for decreasing frictional resistance slidably disposed on a zipper teeth structure according to the instant disclosure.

Referring to FIG. 7, the instant disclosure provides a zipper head assembly structure Z for decreasing frictional resistance comprising a sliding member 1 and a pulling member 2 (such as a pull tab or a pull piece).

First, referring to FIG. 5, FIG. 6 and FIG. 7, the sliding member 1 has a first sliding portion 11, a second sliding portion 12 corresponding to the first sliding portion 11, and a connection portion 13 connected between the first sliding portion 11 and the second sliding portion 12. The first sliding portion 11 has a retaining body 112 and the pulling member 2 has an end portion 20 movably mated with the retaining body 112. The first sliding portion 11 has a first inner surface 1101 and a first outer surface 1102 opposite to the first inner surface 1101, and the first sliding portion 11 has a plurality of first sliding blocks 110 disposed on the first inner surface 1101 thereof and separated from each other by a predetermined distance. The second sliding portion 12 has a second inner surface 1201 and a second outer surface 1202 opposite to the second inner surface 1201, and the second sliding portion 12 has a plurality of second sliding blocks 120 disposed on the second inner surface 1201 thereof and separated from each other by a predetermined distance.

Moreover, referring to FIG. 5, FIG. 6 and FIG. 7, the zipper head assembly structure Z is disposed on a zipper teeth structure 3 (such as a zipper tape or a zipper strip) including a first zipper teeth member 31 (such as a zipper rack or a toothed bar) and a second zipper teeth member 32 mated with each other. The first zipper teeth member 31 includes a first zipper teeth carrier 310 for contacting the first sliding blocks 110 and a plurality of first zipper teeth 311 disposed on the first zipper teeth carrier 310 for contacting the second sliding blocks 120, and the second zipper teeth member 32 includes a second zipper teeth carrier 320 for contacting the first sliding blocks 110 and a plurality of second zipper teeth 321 disposed on the second zipper teeth carrier 320 for contacting the second sliding blocks 120. For example, both the first zipper teeth carrier 310 and the second zipper teeth carrier 320 can be made of waterproof material or any other material having high frictional resistance, but this is merely an example and is not meant to limit the instant disclosure.

More precisely, referring to FIG. 5, FIG. 6 and FIG. 7, both the first zipper teeth carrier 310 and the second zipper teeth carrier 320 are slidably disposed on the first sliding blocks 110, so that both the first zipper teeth carrier 310 and the second zipper teeth carrier 320 are separated from the first inner surface 1101 of the first sliding portion 11 by a first predetermined distance d1. Hence, both the first zipper teeth carrier 310 and the second zipper teeth carrier 320 cannot directly contact the first inner surface 1101 of the first sliding portion 11, so that the frictional resistance between the first zipper teeth carrier 310 (or the second zipper teeth carrier 320) and the first sliding portion 11 is decreased. In addition, both the first zipper teeth 311 and the second zipper teeth 321 are slidably disposed on the second sliding blocks 120, so that both the first zipper teeth 311 and the second zipper teeth 321 are separated from the second inner surface 1201 of the second sliding portion 12 by a second predetermined distance d2. Hence, both the first zipper teeth 311 and the second zipper teeth 321 cannot directly contact the second inner surface 1201 of the second sliding portion 12, so that the frictional resistance between the first zipper teeth 311 (or the second zipper teeth 321) and the second sliding portion 12 is decreased. Therefore, the slideness or the smoothness of the zipper head assembly structure Z sliding on the zipper teeth structure 3 is increased.

In conclusion, when both the first zipper teeth carrier 310 and the second zipper teeth carrier 320 are slidably disposed on the first sliding blocks 110, both the first zipper teeth carrier 310 and the second zipper teeth carrier 320 are separated from the first inner surface 1101 of the first sliding portion 11 by a first predetermined distance d1, so that both the first zipper teeth carrier 310 and the second zipper teeth carrier 320 cannot directly contact the first inner surface 1101 of the first sliding portion 11 in order to decrease the frictional resistance between the first zipper teeth carrier 310 (or the second zipper teeth carrier 320) and the first sliding portion 11. In addition, when both the first zipper teeth 311 and the second zipper teeth 321 are slidably disposed on the second sliding blocks 120, both the first zipper teeth 311 and the second zipper teeth 321 are separated from the second inner surface 1201 of the second sliding portion 12 by a second predetermined distance d2, so that both the first zipper teeth 311 and the second zipper teeth 321 cannot directly contact the second inner surface 1201 of the second sliding portion 12 in order to decrease the frictional resistance between the first zipper teeth 311 (or the second zipper teeth 321) and the second sliding portion 12. Therefore, the slideness or the smoothness of the zipper head assembly structure Z sliding on the zipper teeth structure 3 is increased.

The aforementioned descriptions merely represent the preferred embodiments of the instant disclosure, without any intention to limit the scope of the instant disclosure which is fully described only within the following claims. Various equivalent changes, alterations or modifications based on the claims of the instant disclosure are all, consequently, viewed as being embraced by the scope of the instant disclosure.

What is claimed is:

1. A zipper head assembly structure for decreasing frictional resistance, comprising:

a sliding member having a first sliding portion, a second sliding portion corresponding to the first sliding portion, and a connection portion connected between the first sliding portion and the second sliding portion, wherein the first sliding portion has a retaining body; and a pulling member having an end portion movably mated with the retaining body;

wherein the first sliding portion has a first inner surface and a first outer surface opposite to the first inner surface, the first sliding portion has a plurality of first sliding blocks disposed on the first inner surface thereof and separated from each other, and the retaining body is disposed on the first outer surface of the first sliding portion;

wherein the second sliding portion has a second inner surface and a second outer surface opposite to the second inner surface, and the second sliding portion has a plurality of second sliding blocks disposed on the second inner surface thereof and separated from each other;

wherein the first sliding portion has a first partition block disposed on the first inner surface thereof and between two of the first sliding blocks, and the second sliding portion has a second partition block disposed on the second inner surface thereof and between two of the second sliding blocks, wherein the first partition block and the second partition block are disposed face to face with each other, the height of the first partition block is larger than the height of each first sliding block, and the height of the second partition block is larger than the height of each second sliding block, wherein the second sliding portion has two lateral walls respectively extended from two opposite lateral sides thereof and along a direction facing the first inner surface of the first sliding portion, and the sliding member has a first gap formed between one of the two lateral walls and the first inner surface of the first sliding portion and a second gap formed between the other lateral wall and the first inner surface of the first sliding portion.

2. The zipper head assembly structure of claim 1, wherein the sliding member has a receiving space formed among the first sliding portion, the second sliding portion and the two lateral walls, and the receiving space is divided into a first sliding space and a second sliding space communicated with the first sliding space by matching the first partition block, the second partition block and the connection portion, wherein some of the first sliding blocks and some of the second sliding blocks are disposed inside the first sliding space, and the other first sliding blocks and the other second sliding blocks are disposed inside the second sliding space.

3. A sliding member for decreasing frictional resistance, comprising:

a connection portion connected between the first sliding portion and the second sliding portion;

wherein the first sliding portion has a first inner surface and a first outer surface opposite to the first inner surface, the first sliding portion has a plurality of first sliding blocks disposed on the first inner surface thereof and separated from each other, and the first sliding portion has a retaining body disposed on the first outer surface of the first sliding portion;

wherein the second sliding portion has a second inner surface and a second outer surface opposite to the second inner surface, and the second sliding portion has a plurality of second sliding blocks disposed on the second inner surface thereof and separated from each other;

wherein the first sliding portion has a first partition block disposed on the first inner surface thereof and between two of the first sliding blocks, and the second sliding portion has a second partition block disposed on the second inner surface thereof and between two of the second sliding blocks, wherein the first partition block and the second partition block are disposed face to face with each other, the height of the first partition block is larger than the height of each first sliding block, and the height of the second partition block is larger than the height of each second sliding block, wherein the second sliding portion has two lateral walls respectively extended from two opposite lateral sides thereof and along a direction facing the first inner surface of the first sliding portion, and the sliding member has a first gap formed between one of the two lateral walls and the first inner surface of the first sliding portion and a second gap formed between the other lateral wall and the first inner surface of the first sliding portion.

4. The sliding member of claim 3, further comprising a receiving space formed among the first sliding portion, the second sliding portion and the two lateral walls, and the receiving space is divided into a first sliding space and a second sliding space communicated with the first sliding space by matching the first partition block, the second partition block and the connection portion, wherein some of the first sliding blocks and some of the second sliding blocks are disposed inside the first sliding space, and the other first sliding blocks and the other second sliding blocks are disposed inside the second sliding space.

5. A zipper head assembly structure for decreasing frictional resistance, the zipper head assembly structure disposed on a zipper teeth structure including a first zipper teeth member and a second zipper teeth member mated with each other, the zipper head assembly structure comprising:

a sliding member having a first sliding portion, a second sliding portion corresponding to the first sliding portion, and a connection portion connected between the first sliding portion and the second sliding portion, wherein the first sliding portion has a retaining body; and a pulling member having an end portion movably mated with the retaining body;

wherein the first sliding portion has a first inner surface and a first outer surface opposite to the first inner surface, the first sliding portion has a plurality of first sliding blocks disposed on the first inner surface thereof and separated from each other, and the retaining body is disposed on the first outer surface of the first sliding portion;

wherein the second sliding portion has a second inner surface and a second outer surface opposite to the second inner surface, and the second sliding portion has a plurality of second sliding blocks disposed on the second inner surface thereof and separated from each other;

wherein the first zipper teeth member includes a first zipper teeth carrier for contacting the first sliding blocks and a plurality of first zipper teeth disposed on the first zipper teeth carrier for contacting the second sliding blocks, and the second zipper teeth member includes a second zipper teeth carrier for contacting the first sliding blocks and a plurality of second zipper teeth disposed on the second zipper teeth carrier for contacting the second sliding blocks.

6. The zipper head assembly structure of claim 5, wherein the first sliding portion has a first partition block disposed on the first inner surface thereof and between two of the first sliding blocks, and the second sliding portion has a second partition block disposed on the second inner surface thereof and between two of the second sliding blocks, wherein the first partition block and the second partition block are disposed face to face with each other, the height of the first partition block is larger than the height of each first sliding block, and the height of the second partition block is larger than the height of each second sliding block, wherein the second sliding portion has two lateral walls respectively extended from two opposite lateral sides thereof and along a direction facing the first inner surface of the first sliding portion, and the sliding member has a first gap formed between one of the two lateral walls and the first inner surface of the first sliding portion and a second gap formed between the other lateral wall and the first inner surface of the first sliding portion.

7. The zipper head assembly structure of claim 6, wherein the sliding member has a receiving space formed among the first sliding portion, the second sliding portion and the two lateral walls, and the receiving space is divided into a first sliding space and a second sliding space communicated with the first sliding space by matching the first partition block, the second partition block and the connection portion, wherein some of the first sliding blocks and some of the second sliding blocks are disposed inside the first sliding space, and the other first sliding blocks and the other second sliding blocks are disposed inside the second sliding space.

8. The zipper head assembly structure of claim 7, wherein both the first zipper teeth carrier and the second zipper teeth carrier are slidably disposed on the first sliding blocks, and both the first zipper teeth carrier and the second zipper teeth carrier are separated from the first inner surface of the first sliding portion by a first predetermined distance, wherein both the first zipper teeth and the second zipper teeth are slidably disposed on the second sliding blocks, and both the first zipper teeth and the second zipper teeth are separated from the second inner surface of the second sliding portion by a second predetermined distance.

* * * * *